US010495370B2

(12) United States Patent
Kupferberg

(10) Patent No.: US 10,495,370 B2
(45) Date of Patent: Dec. 3, 2019

(54) COOLING COIL DRAIN PAN

(71) Applicant: Robert Jeffrey Kupferberg, Hampstead (CA)

(72) Inventor: Robert Jeffrey Kupferberg, Hampstead (CA)

( * ) Notice: Subject to any disclaimer, the term of this patent is extended or adjusted under 35 U.S.C. 154(b) by 54 days.

(21) Appl. No.: 15/879,781

(22) Filed: Jan. 25, 2018

(65) Prior Publication Data

US 2019/0226752 A1 Jul. 25, 2019

(51) Int. Cl.

| | |
|---|---|
| ***F25D 21/14*** | (2006.01) |
| ***B08B 3/04*** | (2006.01) |
| ***F24F 13/22*** | (2006.01) |
| *F24F 3/16* | (2006.01) |

(52) U.S. Cl.

CPC ..... *F25D 21/14* (2013.01); *B08B 3/04* (2013.01); *F24F 13/222* (2013.01); *F24F 2003/1675* (2013.01); *F24F 2013/227* (2013.01)

(58) Field of Classification Search

CPC .... F24F 2013/227; F24F 13/222; F25D 21/14

USPC ..... 62/291

See application file for complete search history.

(56) References Cited

U.S. PATENT DOCUMENTS

| | | | | |
|---|---|---|---|---|
| 3,998,069 | A * | 12/1976 | Kronenberger | F25D 17/045 62/288 |
| 5,195,332 | A * | 3/1993 | Sullivan | F24F 1/0007 62/291 |
| 2018/0202704 | A1* | 7/2018 | Long | F25D 21/14 |
| 2019/0145654 | A1* | 5/2019 | Bryant | F24F 13/222 |

* cited by examiner

*Primary Examiner* — Ana M Vazquez

(74) *Attorney, Agent, or Firm* — Welsh Flaxman & Gitler LLC

(57) ABSTRACT

A cooling coil drain pan for an HVAC air handler unit including a base wall with a plurality of side walls extending upwardly therefrom so as to define a pan cavity into which condensation produced by cooling coils of the HVAC air handler unit collects, the base wall is constructed with a triple slope configuration allowing for the flow of condensation collecting in the cooling coil drain pan from a high point along the base wall to a low point along the base wall for the efficient drainage of the condensation and an underside of the cooling coil drain pan includes cavities filled with insulation.

15 Claims, 7 Drawing Sheets

COOLING COIL DRAIN PAN

BACKGROUND OF THE INVENTION

1. Field of the Invention

The present invention generally relates to cooling coil drain pans.

2. Description of the Related Art

Cooling coil drain pans capture condensed water from a cooling coil, and route it to a drain. Whether a drain pan is used in conjunction with vertically positioned cooling coils or horizontally positioned cooling coils, the condensate resulting from the cooling coils flows downward with gravity, and into the drain pan.

A variety of drain pans are known in the art, each having various limitations and shortcomings. As such, a need continues to exist for improvements to cooling coil drain pans.

SUMMARY OF THE INVENTION

It is, therefore, an object of the present invention to provide a cooling coil drain pan for an HVAC air handler unit including a base wall with a plurality of side walls extending upwardly therefrom so as to define a pan cavity into which condensation produced by cooling coils of the HVAC air handler unit collects, the base wall is constructed with a triple slope configuration allowing for the flow of condensation collecting in the cooling coil drain pan from a high point along the base wall to a low point along the base wall for the efficient drainage of the condensation and an underside of the cooling coil drain pan includes cavities filled with insulation.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
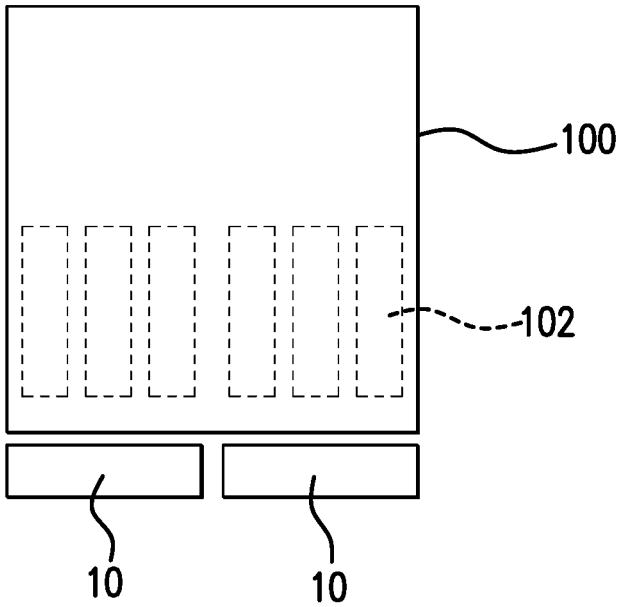
FIG. 1 is front view of the cooling coil drain pan of the present invention in conjunction with a HVAC air handler unit.
Figure 2:
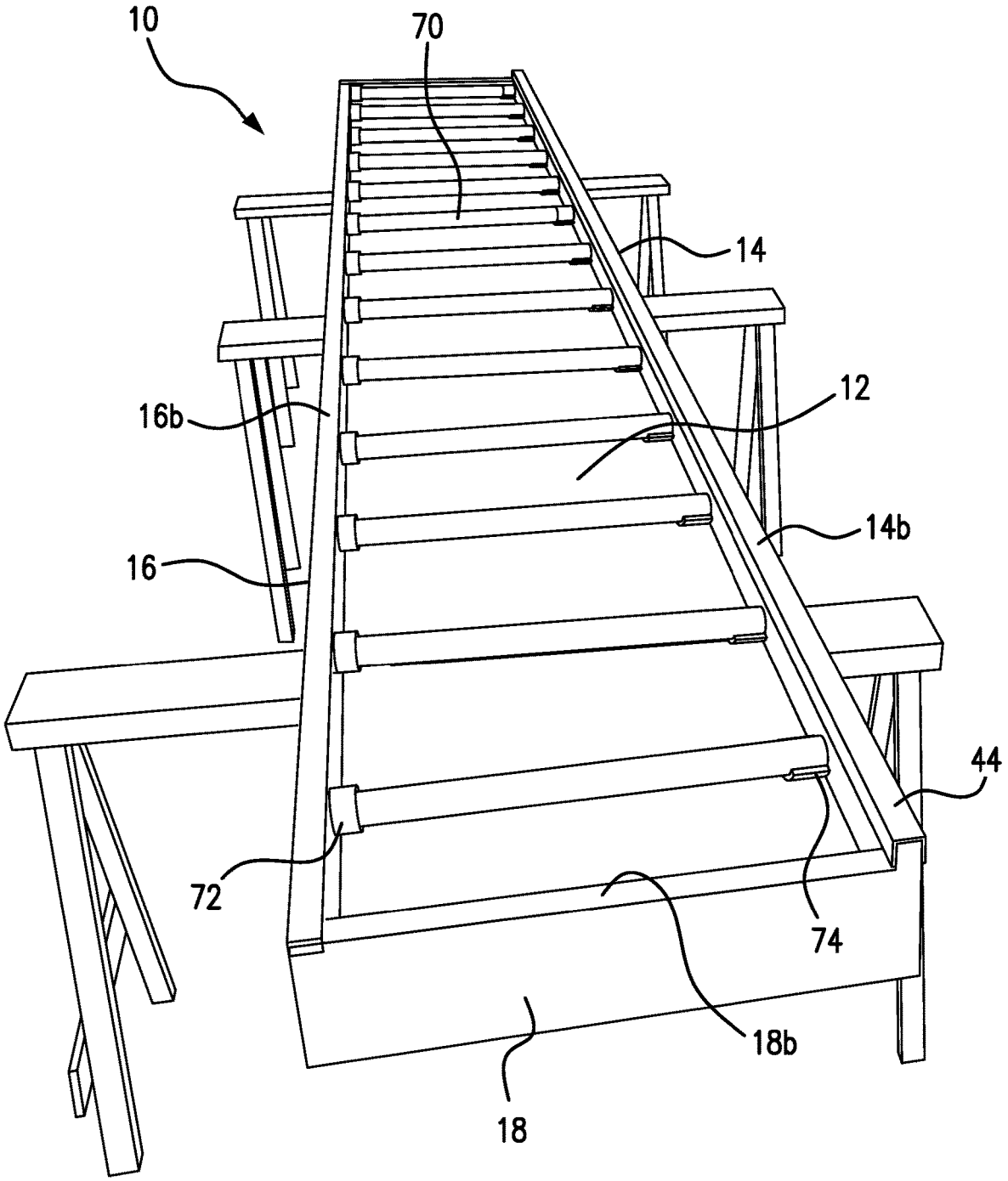
FIG. 2 is a top perspective view of the cooling coil drain pan shown in FIG. 1.
Figure 3:
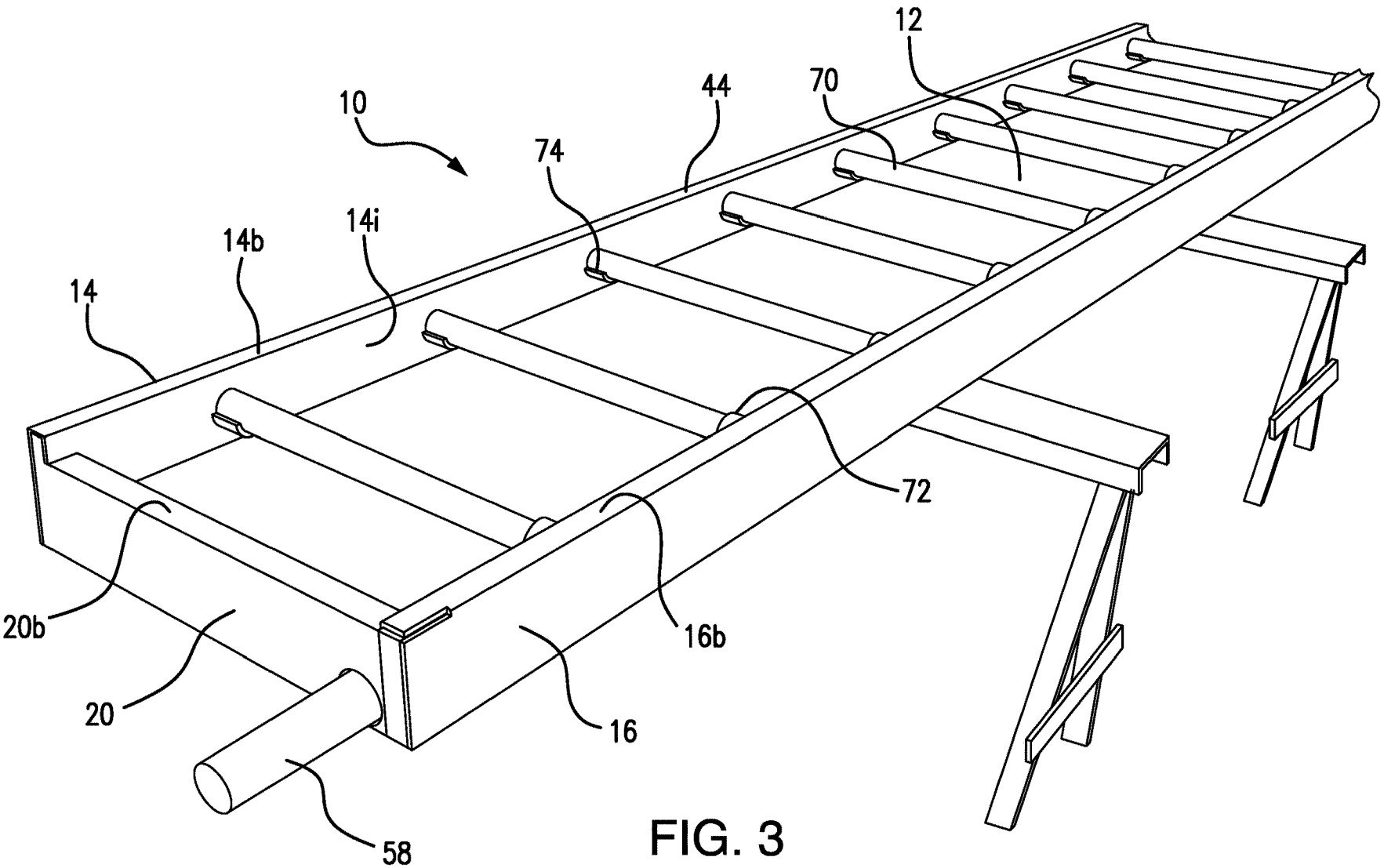
FIG. 3 is a detailed top perspective view of the cooling coil drain pan from the end opposite that shown in FIG. 2.
Figure 4:
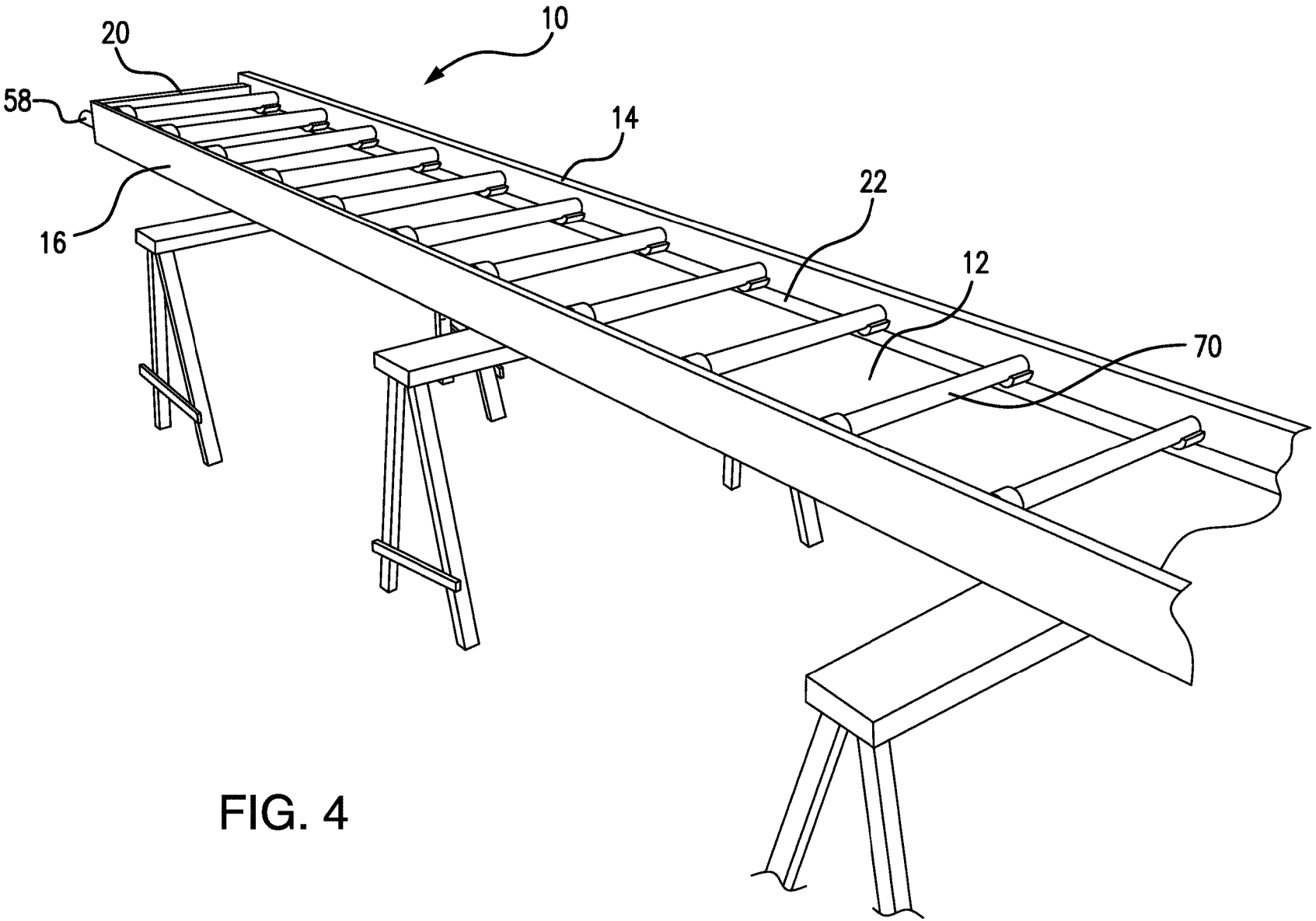
FIG. 4 is another top perspective view of the cooling coil drain pan of the present invention.
Figure 5:
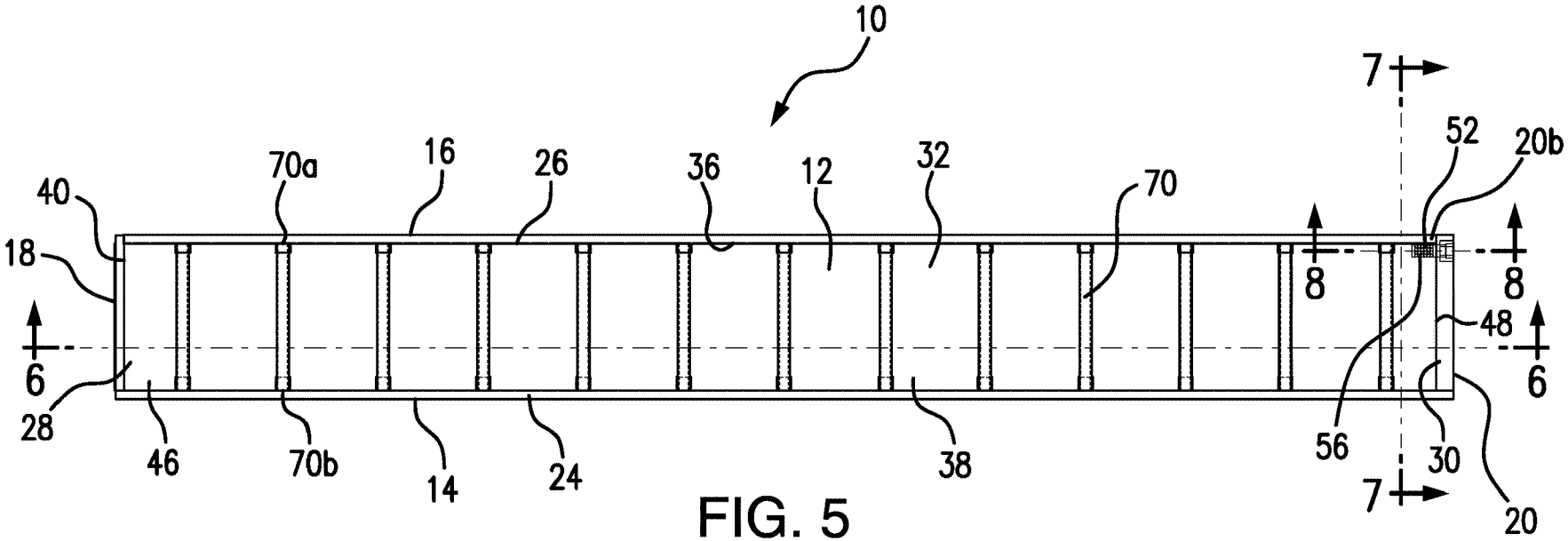
FIG. 5 is a top plan view of the cooling coil drain pan of the present invention.
Figure 6:
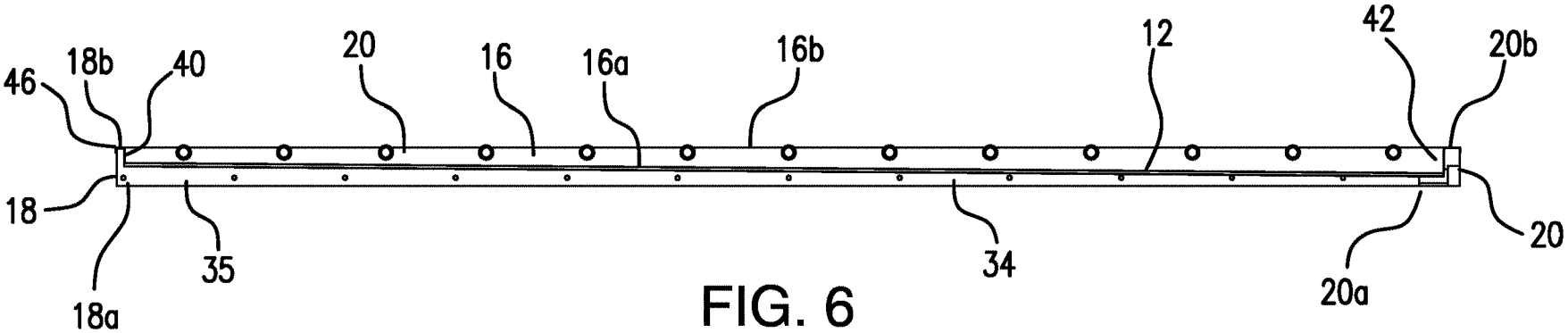
FIG. 6 is a cross sectional view of the cooling coil drain pan along the line 6-6 in FIG. 5.
Figure 7:
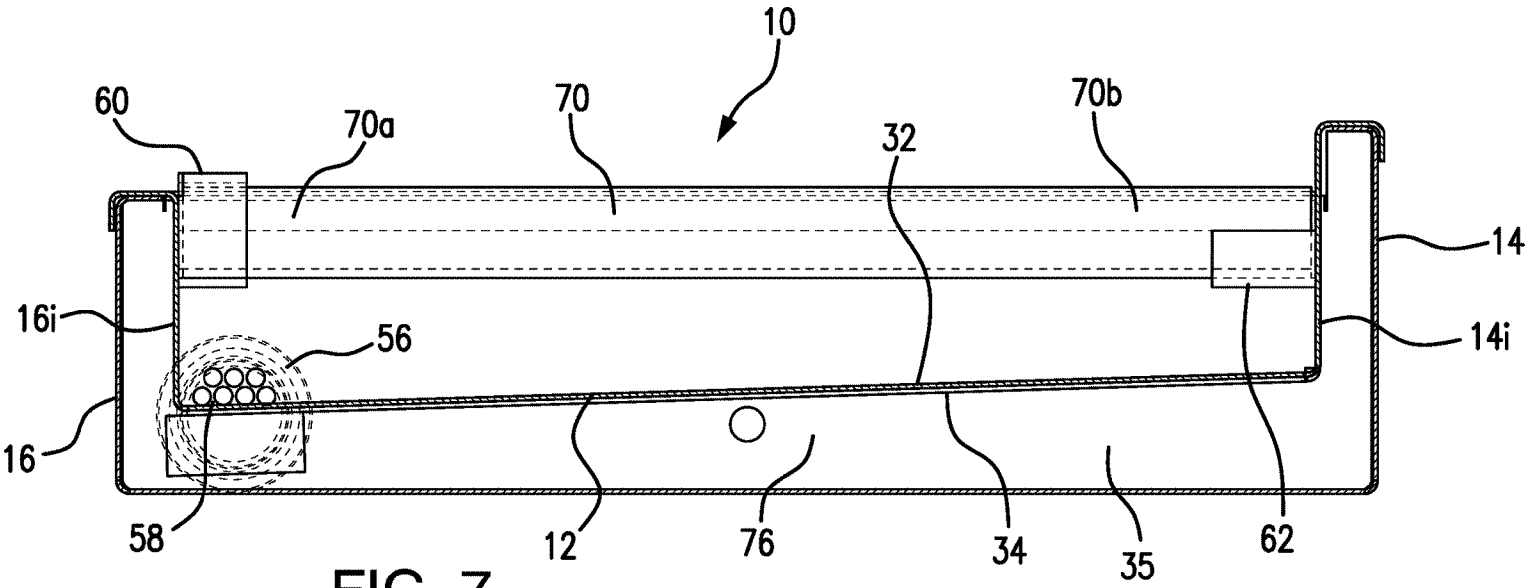
FIG. 7 is a cross sectional view of the cooling coil drain pan along the line 7-7 in FIG. 5.
Figure 8:
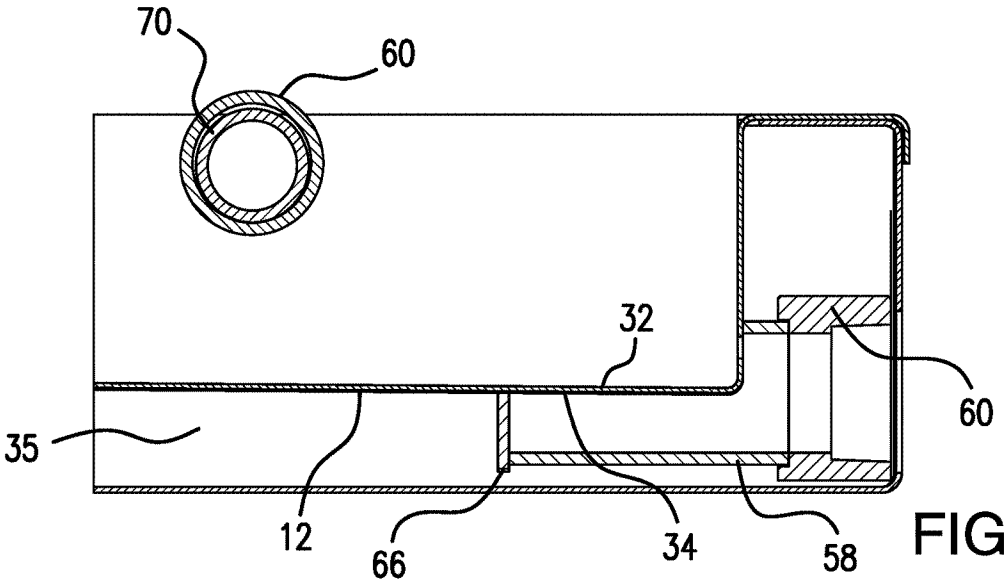
FIG. 8 is a cross section view of the cooling coil drain pan along the line 8-8 in FIG. 5.
Figure 9:
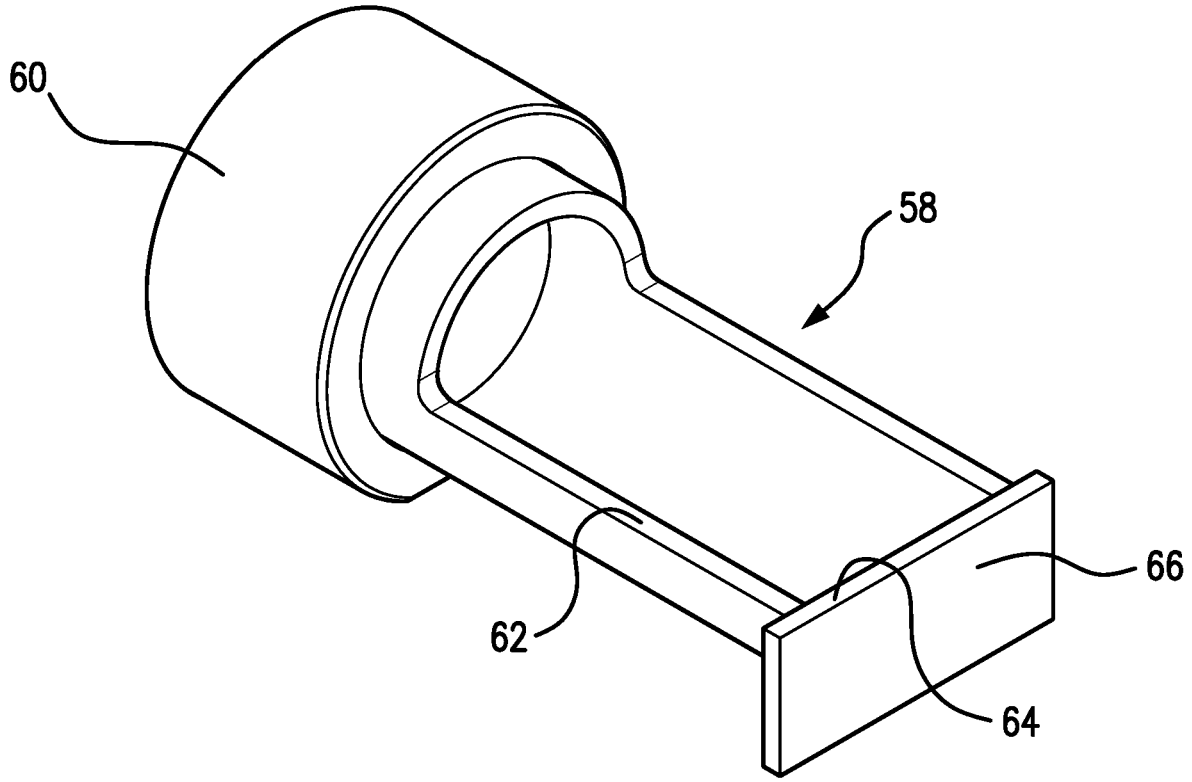
FIG. 9 is a detailed perspective view of the drain tube.

Referring to FIGS. 1 to 9, a cooling coil drain pan 10 is disclosed. The cooling coil drain pan 10 is adapted for use in conjunction with a variety of cooling systems. For example, the cooling coil drain pan 10 of the present invention may be used in conjunction with vertically positioned cooling coils or it may be used in conjunction with horizontally positioned cooling coils of an HVAC air handler unit 100. Still further, the cooling coil drain pan 10 of the present invention may be used alone or a plurality of drain pans 10 in accordance with the present invention may be combined so as to cover a larger area requiring the collection of accumulated condensation. The provision of the present drain pan 10 allows for regular cleaning and thus prevents the build-up of bacteria and other impurities.

The cooling coil drain pan 10 includes a base wall 12 with a plurality of side walls 14, 16, 18, 20 extending upwardly therefrom so as to define a pan cavity 22 into which condensation produced by the cooling coils 102 collects and is ultimately removed from the vicinity of the cooling coils 102 and the HVAC air handler unit 100 itself. The base wall 12 and the plurality of side walls 14, 16, 18, 20 are preferably constructed with an insulated construction to prevent condensation from forming around the walls of the cooling coil drain pan 10. The cooling coil drain pan 10 is substantially rectangular in shape when viewed from above, and is shaped and dimensioned for selective insertion and retrieval from the HVAC air handler unit 100 as may be required during the maintenance of the HVAC air handler unit 100. Still further, the present drain pan 10 is adapted for use in conjunction with a wide variety of HVAC air handler units. When in used in conjunction with HVAC air handler units 100, the condensation flows into the drain pan 10, thereby avoiding the build-up of condensation and other materials on the concrete beneath the HVAC air handler unit 100. As those skilled in the art will certainly appreciate, and as shown with reference to FIG. 1, the present cooling coil drain pan 10 is adapted for positioning beneath an HVAC air handler unit 100 in the vicinity of the cooling coils 102 such that condensate from the cooling coils 102 will drip directly into the cooling coil drain pan 10.

The base wall 12 is substantially rectangular in shape when viewed from above. As such, the base wall 12 includes first and second long edges 24, 26 and first and second short edges 28, 30. The base wall 12 also includes an upper surface 32 and a lower surface 34, which are connected to the first and second long edge walls 36, 38 and first and second short edges walls 40, 42 formed at the respective first and second long edges 24, 26 and first and second short edges 28, 30.

The previously mentioned side walls 14, 16, 18, 20 of the cooling coil drain pan 10 extend upwardly from the upper surface 32 of the base wall 12 at locations adjacent to the first and second long edges 24, 26 and the first and second short edges 28, 30. More particularly, the cooling coil drain pan 10 includes first and second long side walls 14, 16 extending upwardly from the upper surface 32 at the first and second long edges 24, 26, respectively. The cooling coil drain pan 10 also includes first and second short side walls 18, 20 extending upwardly from the upper surface 32 at the first and second short edges 28, 30. With this in mind, each of the first and second long side walls 14, 16 and the first and second short side walls 18, 20 includes a lower edge 14*a*, 16*a*, 18*a*, 20*a* connected to the upper surface 32 of the base wall 12 and an upper edge 14*b*, 16*b*, 18*b*, 20*b* positioned above the base wall 12. The upper edges 16*b*, 18*b*, 20*b* of the second long side wall 16 and the first and second short side walls 18, 20 all lie in the same horizontal plane, while the upper edge 14*b* of the first long side wall 14 extends above the upper edges 16*b*, 18*b*, 20*b* of the other side walls 16, 18, 20. The extension of the first long side wall 14 in this way defines a flange 44 that prevents water from flowing over the cooling coil drain pan 10 to the external environment.

In accordance with a preferred embodiment, the underside of the cooling coil drain pan 10 is formed with cavities 76 allowing for the application of insulation 35. The insulation 35 alleviates problems associated with ice build-up by controlling the temperature of the drain pan 10 and thereby avoiding the formation of ice to the extent possible. In accordance with a preferred embodiment, the insulation 35 is applied by blowing known insulation material on the underside of the drain pan 10.

The base wall 12 is constructed with a triple slope configuration, allowing for the flow of condensation collecting in the cooling coil drain pan 10 from a high point 46 along the base wall 12 to a low point 48 along the base wall 12 for the efficient drainage of the condensation. The base wall 12 therefore includes a distinctly sloped surface 50, having a high point 46 adjacent the intersection of the first long side wall 14 and the first short side wall 18 and low point 48 adjacent the intersection of the second long side wall 16 and the second short side wall 20. At the intersection of the first long side wall 14 and the second short side wall 20, the base wall 12 (intermediate point A) is located at a position between the high point 46 and the low point 48. In order to ensure that condensation all drains toward the low point 48, the base wall 12 at intermediate point B is higher than at intermediate point A. As such, the base wall 12 exhibits a flat planar surface which has a high point 46, intermediate point B between the high point 46 and intermediate point A, intermediate point A between intermediate point B and low point 48, and a low point 48 to which all the condensation ultimately flows. Similarly, at the intersection of the second long side wall 16 and the first short side wall 18, the base wall 12 is located at a position between the high point 46 and the low point 48. As a result, any condensation falling upon the base wall 12 is encouraged to flow toward the low point 48 and out a drainage aperture 52 formed in the base wall 12 and second short side wall 20 adjacent the intersection of the second long side wall 16 and the second short side wall 20.

It should be appreciated that the references to the high point 46 of the base wall 12 and the low point 48 of the base wall 12 are relative terms based upon positioning of the base wall 12 when the cooling coil drain pan 10 is positioned for use in its substantially horizontal configuration. As such, and presuming the upper edge 16*b* of the respective second long side wall 16 and the upper edges 18*b*, 20*b* of the respective first and second short side walls 18, 20 define a horizontal plane, the high point 46 would be that point along the base wall 12 that is closest to the horizontal plane, intermediate point B would be the next closest to the horizontal plane, intermediate point A would be the third closest to the horizontal plane and the low point 48 would be that point along the base wall 12 that is furthest from the horizontal plane. As such, and given that the base wall 12 extends downwardly at all points therealong from the high point 46 to the low point, gravity will force condensation to flow from the high point 46 to the low point 48.

Optimal drainage of water from the cooling coil drain pan 10 is achieved by the provision of a drainage aperture 52 formed in the base wall 12 and the second short side wall 20 adjacent the intersection of the second long side wall 16 and the second short side wall 20. The drainage aperture 52 is fully covered with a strainer 56. The strainer 56 is built into the cooling coil drain pan 10 as a single piece and is structured to extend up the second short side wall 20 where water often accumulates. As such, the strainer 56 is structured to catch debris allowing the debris to be easily cleaned out when the drain pan 10 is cleaned. It is further appreciated the strainer 56 may be structured to be fixed or removable relative to the drainage aperture 52.

A drain tube 58 is provided for attachment to the cooling coil drain pan 10 so as to fully cover the drainage aperture 52 and allow for the free flow of water from the cooling coil drain pan 10 through the drainage aperture 52 and into the drain tube 58. The drain tube 58 includes a cylindrical portion 60 from which a semicircular portion 62 extends. The free end 64 of the semicircular portion 62 is closed off by a wall member 66 that forces all fluid to flow from the semicircular portion 62 and through the cylindrical portion 60. The combination of the cylindrical portion 60 and the semicircular portion 62 define an L-shaped interface that is secured at the junction of the base wall 12 and the second short side wall 20 with the drain tube 58 secured to the lower surface 34 of the base wall 12 and the external surface of the second short side wall 20.

While the disclosed embodiment includes a single drainage aperture, it is appreciated the drain pan may be constructed with multiple drainage apertures. Where multiple drainage apertures are employed, the sloped surface of the base wall would be adjusted accordingly to accommodate the various drainage apertures.

In addition to the sloped configuration of the cooling coil drain pan 10, the cooling coil drain pan 10 is provided with a plurality of tubular coil supports 70 extending between the first and second long side walls 14, 16. The tubular coil supports 70 are arranged to lie in a plane substantially parallel to the plane defined by the upper edges 16*b*, 18*b*, 20*b* of the second long side wall 16 and the first and second short side walls 18, 20. The tubular coil supports 70 are positioned adjacent to the upper edge 16*b* of the second long side wall 16 and at various relative locations along the first long side wall 14 (due to the slope of base wall 12 ultimately changing the relative position of tubular coil supports 70 along the interior surface 14*i* of the first long side wall 14). The plurality of tubular coil supports 70 are provided such that they are spaced along the length of the cooling coil drain pan 10 which is covered thereby. As such, coils requiring removal may be rested upon the tubular coil supports 70 and moved across the surface defined by the tubular coil supports. As such, and as will be appreciated based upon the following disclosure, the tubular coil supports 70 are constructed so as to be rotatable.

In accordance with a preferred embodiment, each of the plurality of tubular coil supports 70 is cylindrical. As a result, any condensation falling thereon will not sit upon the plurality of tubular coil supports 70 but will rather shed therefrom and fall to the base wall 12. Further, the plurality of tubular coil supports 70 are not fixedly secured to the first and second long side walls 14, 16, but are rather secured to the first and second long side walls 14, 16 in a manner allowing for relative rotation or removal between the plurality of tubular coil supports 70 and the respective first and second long side walls 14, 16. The provision of the relative motion between the plurality of tubular coil supports 70 and the first and second long side walls 14, 16 allow the plurality of tubular coil supports 70 to roll as cooling coils are inserted or retrieved from the cooling system.

The rotating mounting of the plurality of tubular coil supports 70 to the respective first and second long side walls 14, 16 is achieved through the provision of cylindrical bearings 72 along the inner surface 16*i* of the second long side wall 16 and semi-circular or arcuate bearing members 74 along the inner surface 14*i* of the first long side wall 14 (the semi-circular or arcuate bearing members 74 being secured to the first long side wall 14 such that the convex surface thereof faces the base wall 12). The cylindrical bearings 72 and the semi-circular or arcuate bearing members 74 are secured to the respective second and first long side walls 16, 14 as paired elements aligned such that when a tubular coil support 70 is positioned to extend between the first and second long side walls 14, 16, the longitudinal axis of the tubular coil support 70 is perpendicular to both the longitudinal axes of the first and second long side walls 14, 16. In practice, and once the cylindrical bearings 72 and the semi-circular or arcuate bearing members 74 are secured to the respective second and first long side walls 16, 14, installation of the tubular coil supports 70 is achieved by first inserting one end 70*a* of the tubular coil support 70 within the cylindrical bearing 72 and then allowing the second end 70*b* of the tubular coil support 70 to sit within the concave recess defined by the semi-circular or arcuate bearing members 74. Removal of the tubular coil supports 70, when necessary, is achieved by simply reversing this process.

While the preferred embodiments have been shown and described, it will be understood that there is no intent to limit the invention by such disclosure, but rather, it is intended to cover all modifications and alternate constructions falling within the spirit and scope of the invention.

REFERENCE NUMERALS

10 cooling coil drain pan 10
12 base wall 12
14*a* lower edge 14*a*, 16*a*, 18*a*, 20*a*
14*b* upper edge 14*b*
14 first long side wall 14
14*i* inner surface 14*i*
16 second long side wall 16
16*b* upper edge 16*b*
16 second long side wall 16
16*i* inner surface 16*i*
18 first short side wall 18
18*b* upper edges 18*b*, 20*b*
20 second short side wall 20
22 pan cavity 22
24 first and second long edges 24, 26
28 first and second short edges 28, 30
32 upper surface 32
34 lower surface 34
36 first and second long edge walls 36, 38
40 first and second short edges walls 40, 42
44 flange 44
46 high point 46
48 low point 48
50 slope surface 50
52 drainage aperture 52
56 strainer 56
58 drain tube 58
60 cylindrical portion 60
62 semicircular portion 62
64 free end 64
66 wall member 66
70 tubular coil supports 70
70*a* first inserting one end 70*a*
70*b* second end 70*b*
72 cylindrical bearings 72
74 semi-circular or arcuate bearing members 74
100 HVAC air handler unit
102 cooling coils

The invention claimed is:

1. A cooling coil drain pan for an HVAC air handler unit, comprising:

a base wall with a plurality of side walls extending upwardly therefrom so as to define a pan cavity into which condensation produced by cooling coils of the HVAC air handler unit collects; and a plurality of tubular coil supports extending between side walls of the cooling coil drain pan; wherein arcuate bearing members are provided on a first side wall of the cooling drain pan and cylindrical bearings are provided on a second side wall of the cooling drain pan for supporting the plurality of tubular coil supports.

2. The cooling coil drain pan according to claim 1, wherein an underside of the cooling coil drain pan includes cavities filled with insulation.

3. The cooling coil drain pan according claim 2, wherein the base wall is constructed with a slope configuration allowing for a flow of condensation collecting in the cooling coil drain pan from a high point along the base wall to a low point along the base wall for an efficient drainage of the condensation.

4. The cooling coil drain pan according claim 2, further including a drainage aperture positioned at the low point.

5. The cooling coil drain pan according claim 3, wherein the drainage aperture is formed in the base wall and a side wall.

6. The cooling coil drain pan according to claim 1, wherein the base wall is constructed to allow for a flow of condensation collecting in the cooling coil drain pan from a high point along the base wall to a low point along the base wall for an efficient drainage of the condensation; and a drainage aperture is positioned at the low point.

7. The cooling coil drain pan according claim 6, wherein the drainage aperture is formed in the base wall and a side wall.

8. The cooling coil drain pan according claim 6, wherein the drainage aperture is covered with a strainer.

9. The cooling coil drain pan according claim 6, wherein a drain tube fully covers the drainage aperture and allows for a free flow of water from the cooling coil drain pan through the drainage aperture and into the drain tube.

10. The cooling coil drain pan according claim 9, wherein the drain tube includes a cylindrical portion from which a semicircular portion extends, and a free end of the semicircular portion is closed off by a wall member that forces all fluid to flow from the semicircular portion and through the cylindrical portion.

11. The cooling coil drain pan according claim 6, wherein each of the plurality of tubular coil supports is cylindrical.

12. The cooling coil drain pan according claim 6, wherein each of the plurality of tubular coil supports is secured to the side walls in a manner allowing for relative rotation or removal.

13. The cooling coil drain pan according claim 1, wherein the plurality of tubular coil supports are arranged to lie in a plane substantially parallel to a plane defined by upper edges of the plurality of side walls.

14. The cooling coil drain pan according claim 1, wherein each of the plurality of tubular coil supports is cylindrical.

15. The cooling coil drain pan according claim 1, wherein each of the plurality of tubular coil supports is secured to the side walls in a manner allowing for relative rotation or removal.

* * * * *